United States Patent [19]

McFadyen

[11] 4,353,480

[45] Oct. 12, 1982

[54] CLOSURE FOR A DISPENSER CONTAINER

[75] Inventor: Robert C. McFadyen, North Ryde, Australia

[73] Assignee: Lever Brothers Company, New York, N.Y.

[21] Appl. No.: 254,832

[22] Filed: Apr. 16, 1981

Related U.S. Application Data

[63] Continuation of Ser. No. 47,428, Jun. 11, 1979, abandoned.

[51] Int. Cl.[3] ..... A47K 10/38

[52] U.S. Cl. ..... 221/63

[58] Field of Search ..... 221/63, 307, 308, 310, 221/33, 47, 52, 56; 206/205, 210; 222/491, 494, 548

[56] References Cited

U.S. PATENT DOCUMENTS

| | | | |
|---|---|---|---|
| 1,972,344 | 9/1934 | Jackson | 222/494 |
| 3,160,329 | 12/1964 | Radic et al. | 222/494 X |
| 4,141,475 | 2/1979 | Nilson | 222/494 |

*Primary Examiner*—Stanley H. Tollberg

[57] ABSTRACT

A closure for a dispenser-container for moist tissues or the like which minimizes evaporation of the tissue stored in a continuous length in the container. The closure comprises two superimposed diaphragms each having an opening therein completely out of register with the other, at least one of the openings being resiliently sealed by the other diaphragm. The tissue is drawn from the container through the two openings.

3 Claims, 3 Drawing Figures

CLOSURE FOR A DISPENSER CONTAINER

This is a continuation application of parent application Ser. No. 47,428, filed on June 11, 1979, now abandoned.

This invention relates to a closure for containers for storing and dispensing moist tissues or the like and more particularly to a container closure adapted to maintain the tissues in the container in a moist condition over a long period. The tissues are stored in the container in continuous rolled or folded length suitably perforated at spaced transverse lines to provide separable tissues of appropriate size. Such containers are referred to as dispenser-containers hereinafter.

Generally dispenser-containers have included an opening in one wall of the container in the form of a straight or cross shaped slit through which tissues may be drawn. A problem with these prior art dispenser containers is that a portion of tissue to be next extracted necessarily protrudes through the slit opening and sometimes separates the edges of the slit to a considerable extent. This separation allows some escape of the evaporable fluids with which the tissue is impregnated in its moist state.

An object of the present invention, therefore, is to provide a closure for a dispenser-container that reduces direct escape to atmosphere of the evaporable moistening fluids by comparison with conventional slit wall containers.

The invention provides a closure for a dispenser-container mouth comprising an inner and outer diaphragm each with an opening therethrough completely out of register with other, the opening in at least one of the diaphragms being resiliently sealed by the other diaphragm.

Thus in what is probably the simplest form of the invention the closure comprises two resilient diaphragms lying flatly one against the other and each pierced by an opening such that the two openings are completely out of register, each of the diaphragms resiliently sealing the hole in the other diaphragm. In such instance if a tissue is to be removed from the container it must pass through one opening and then between the two diaphragms across a zone of contact to the other opening and through that opening to the exterior of the container. The passage of the tissue from one opening to the other across the zone of contact is of course permitted as a result of resilient flexure or deformation of the diaphragms.

Instead of the entire areas of the diaphragms contacting one another the diaphragms can contact each other at least over a continuous contact zone which surrounds the opening in only one of the diaphragms. Such a contact zone seals one opening from the other and can be provided for example by a rib or protrusion surrounding the opening. Providing a contact zone surrounding the opening in both of the diaphragms can increase the seal between the openings.

Conveniently the contact zone rims the opening in a diaphragm.

A frustoconical wall portion can extend from a diaphragm to terminate in a free end forming the opening in the diaphragm. The frustoconical wall portion can be in the outer diaphragm, the frustum providing a recess in the top of the diaphragm in which the free end of the next extracted tissue can be contained and readily gripped between the users fingers.

The frustoconical wall portion can be resilient, a particularly good seal being achievable between the contact zone rimming the opening at the free end of the frustum and the other diaphragm.

To minimise the risk of the frustoconical wall portion being inverted in use the frustoconical wall portion is preferably a frustum of an oblique cone.

The opening in a diaphragm can be provided with an edge flange extending along at least part of the edge of the opening to minimise the risk of tearing the tissue as it is pulled through the opening.

A convenient construction is to provide an inner diaphragm adapted to snap engage the mouth of a container and an outer diaphragm adapted to snap engage with the inner diaphragm. An external snap fitting cap can be provided for covering the opening in the outer diaphragm between uses to reduce the drying up of the protruding free end of the next extracted tissue.

By way of example an embodiment of the invention will now described with reference to the accompanying drawings in which.

Figure 1:
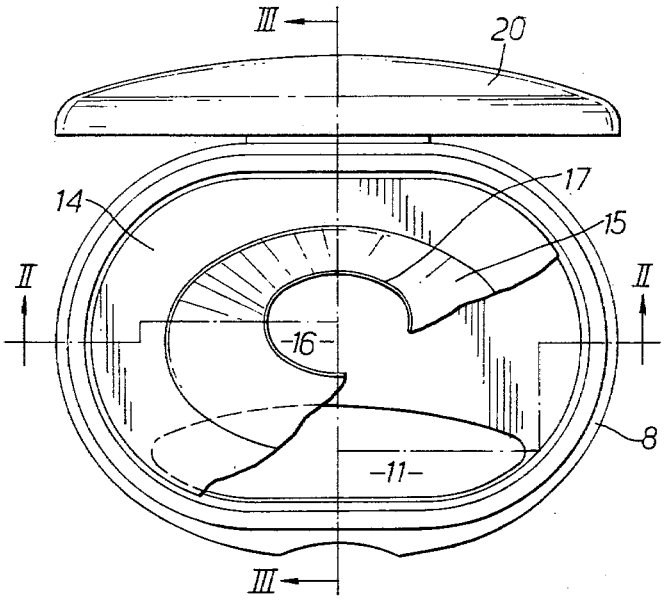
FIG. 1 is a plan view of a closure with the cap in the open position, part of the outer diaphragm being cut away to show the inner diaphragm.

The illustrated closure is shown applied to the mouth of an open topped, tub-like container 4 having a detent rib 5 around the mouth.

The closure comprises a stiff or rigid inner diaphragm 6 which itself comprises a planar central portion 7 and a channel-shaped, circumferential flange structure 8 having an outer detent rib 9 and an inner detent rib 10. The outer detent rib 9 snap fits over the detent rib 5 of the mouth of container 4 so as to secure the diaphragm thereto in hermetic engagement therewith.

The central portion 7 of diaphragm 6 has an opening 11 formed in it of more or less elliptical shape. The curved edge of the opening 11 nearer to the center of the diaphragm is defined by a downwardly directed flange 12 integral with the diaphragm.

An outer diaphragm 13 is made of an elastomeric or resilient plastics material. The outer diaphragm has a planar portion 14 from which a resilient fructoconical wall portion 15 extends to terminate at the free end in an elliptical opening 16 forming the opening through the diaphragm 13 having a rim 17. The frustoconical portion 15 is a frustum of an oblique substantially elliptical cone so that the inclined surface surrounding the opening 16 is of varying width from place to place about the periphery of the opening.

The outer diaphragm 13 is secured in place by means of a detent rim flange 18 having a detent rib 19 thereon which snap fits into the inner detent rib 10 of the flange structure 8 the outer diaphragm.

When secured in position relative to the inner diaphragm the rim of the opening 16 in the outer diaphragm resiliently contacts the planar portion 7 of the inner diaphragm, the rim 17 of the opening forming the continuous contact zone surrounding the opening 16 in only the outer diaphragm and not surrounding or overlapping the opening 11 in the inner diaphragm. The resilient engagement of the rim of the opening 16 with the inner diaphragm forms a substantially hermetic seal of the opening 16 to seal the container.

An outer closure cap 20 is secured to the flange structure 8 of the inner diaphragm by an integral hinge 21. The lid is a snap fit in the closed position with the closure and presents not only a pleasing appearance when the container is closed but also further assists in rendering the entire closure a hermetic seal for the mouth of the container.

In use the container has a folded length of tissue sheet packed within it and may have a moistening fluid which may be scented as desired. The tissue sheet is suitably perforated at spaced apart transverse lines to provide separable tissues of appropriate size.

Figure 3:
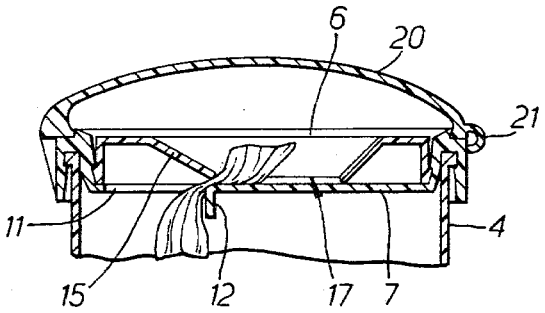
FIG. 3 is a sectional view taken on the line III—III of FIG. 1.
Figure 2:
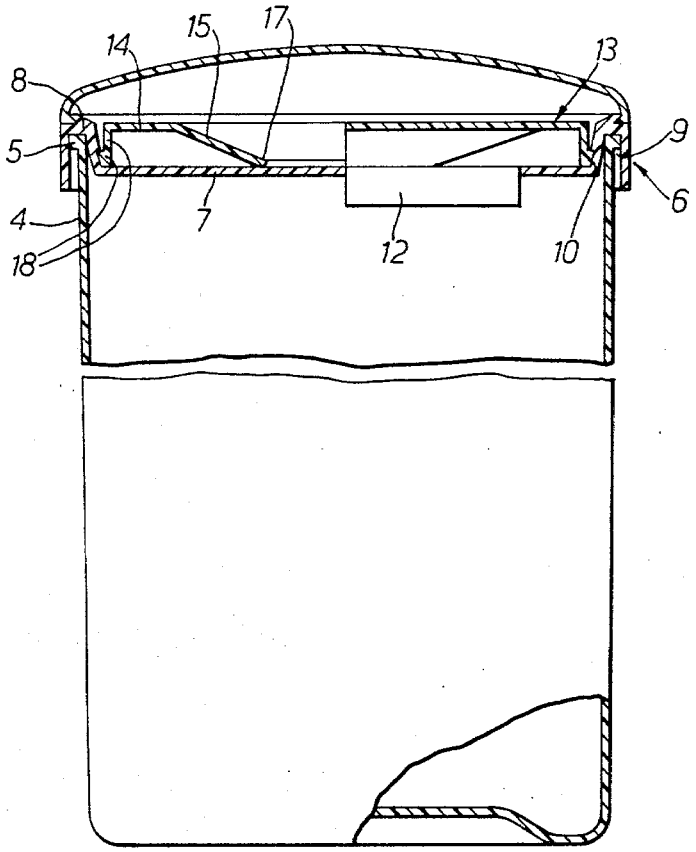
FIG. 2 is a partly sectioned side elevation of the closure along the line II—II of FIG. 1 applied to a container and with the cap closed.

The free end of first tissue to be extracted is compressed and extended through the opening 11 in the inner diaphragm and under the rim 17 of the opening 16 which is completely out of register with the opening 11 to be held thereby in pressure contact with the central planar portion 7 of diaphragm 6. The free end of the length of tissue is then disposed substantially as shown in FIG. 3 in the recess formed by the frustoconical wall portion 15 where it can be readily gripped by the user. Tissues may be withdrawn as desired by gripping the free end of the tissue next to be extracted and pulling it away from the container through opening 16.

When a tissue is being withdrawn a portion of the next tissue will be pulled under the rim 17 of opening 16 as a result of resilient deformation of the fructoconical portion of diaphragm 13 before the first mentioned tissue tears away, thus rendering the next tissue ready for removal.

As the length of tissue enters the opening 11 in the inner diaphragm it rubs over the flange 12 at the edge of the opening 11, the flange 12 guarding against the tissue being torn against the relatively sharp edge of the opening 11 which would be presented to the tissue in the absence of the flange 12.

Pulling the tissue through the opening 16 in the outer diaphragm tends to cause the frustoconical portion to invert but this risk is reduced because the frustum is that of an oblique cone.

Whilst dependent on the thickness and compressibility of the tissue, and the resiliency of the diaphragm, the closure provides an improved sealing of the container to minimise the evaporation or drying out of the tissues. Between uses the sealing is further improved by closing the cap 20.

Other embodiments of the invention are of course possible in which a frustoconical wall portion, resilient or rigid, can be provided on one or both of the diaphragms. When the frustoconical portion is rigid the necessary resilience to obtain the desired seal can be obtained either from resilience elsewhere in the diaphragm or in the other diaphragm. Substantially flat diaphragms can be used one or both of which may have contact zones surrounding or rimming the openings.

One or other of the diaphragms may be integral with the container closed thereby.

Closures according to the invention may be applied to any form of container, including those of a pliable or flexible nature.

What is claimed is:

1. A dispenser-container for a perforated web of tissues comprising an open top tub-like container for storing a web of tissues and a closure formed by an inner and an outer diaphragm each having an opening therethrough, the openings being adjacent to and completely out of register with each other, at least one of the diaphragms being resilient to urge the diaphragms together and resiliently seal one of the openings, the tissue web being threaded in turn through the opening in the inner diaphragm and the opening in the outer diaphragm.

2. A dispenser-container for a perforated web of tissues comprising a rigid open top tube-like container for storing a web of tissues and a closure formed by an inner planar diaphragm having an opening therethrough and an outer diaphragm spaced apart from the inner diaphragm and having a frustoconical wall portion inclined inwardly to a free end forming an opening in the outer diaphragm, the free end resiliently sealing with the planar inner diaphragm adjacent to and completely out of register with the opening in the inner diaphragm, the frustonconical portion forming a recess wherein the free end of the web of tissues threaded in turn through the openings in the inner and outer diaphragms can be gripped.

3. A dispenser-container according to claim 1 in which the frustonconical wall portion is in the shape of a frustum of an oblique cone.

* * * * *

UNITED STATES PATENT AND TRADEMARK OFFICE

CERTIFICATE OF CORRECTION

PATENT NO. : 4,353,480

DATED : October 12, 1982

INVENTOR(S) : Robert C. McFadyen

It is certified that error appears in the above-identified patent and that said Letters Patent are hereby corrected as shown below:

Claim 3, line 1, "according to claim 1" should read --according to claim 2--.

Signed and Sealed this

*Twenty-eighth* Day of *June 1983*

[SEAL]

*Attest:*

GERALD J MOSSINGHOFF

*Attesting Officer*

*Commissioner of Patents and Trademarks*